US011209140B2

(12) United States Patent
Jiang

(10) Patent No.: US 11,209,140 B2
(45) Date of Patent: Dec. 28, 2021

(54) MULTICOLOR LIGHTING ADJUSTING DEVICE

(71) Applicant: Guangzhou Haoyang Electronic Co., Ltd., Guangdong (CN)

(72) Inventor: Weikai Jiang, Guangdong (CN)

(73) Assignee: Guangzhou Haoyang Electronic Co., Ltd.

( * ) Notice: Subject to any disclaimer, the term of this patent is extended or adjusted under 35 U.S.C. 154(b) by 0 days.

(21) Appl. No.: 17/059,816

(22) PCT Filed: Dec. 5, 2019

(86) PCT No.: PCT/CN2019/123347
§ 371 (c)(1),
(2) Date: Nov. 30, 2020

(87) PCT Pub. No.: WO2020/199636
PCT Pub. Date: Oct. 8, 2020

(65) Prior Publication Data

US 2021/0247040 A1 Aug. 12, 2021

(30) Foreign Application Priority Data

Mar. 29, 2019 (CN) ..... 201920413685.0

(51) Int. Cl.
*F21S 10/00* (2006.01)
*F21V 9/08* (2018.01)

(52) U.S. Cl.
CPC ..... *F21S 10/007* (2013.01); *F21V 9/08* (2013.01)

(58) Field of Classification Search
CPC ..... F21S 10/007; F21V 9/08
See application file for complete search history.

(56) References Cited

U.S. PATENT DOCUMENTS 4,894,760 A 1/1990 Callahan
2006/0034089 A1* 2/2006 Rasmussen ..... F21S 10/007 362/382

(Continued)

FOREIGN PATENT DOCUMENTS

CN 102943996 A * 2/2013
CN 102943996 A 2/2013

(Continued)

OTHER PUBLICATIONS

International Search Report for Application No. PCT/CN2019/123347, dated Feb. 26, 2020, pp. 1-3.

*Primary Examiner* — Mary Ellen Bowman
(74) *Attorney, Agent, or Firm* — Lerner, David, Littenberg, Krumholz & Mentlik, LLP

(57) ABSTRACT

A multicolor lighting adjusting device includes a substrate with a light transmission hole, a transparent color mixing plate mounted on the substrate, and a drive mechanism for driving the color mixing plate. The color mixing plate has a plurality of color zones thereon, the color zones are randomly distributed in shape and/or color, and the colors of two adjacent color zones are mutually different. The color mixing plate has a first remaining position at which point a light beam passing through the light transmission hole is intercepted by at least two of the color zones on the color mixing plate. With this device, the light beam passing through the light transmission hole is intercepted by at least two color zones on the color mixing plate, so that the projected light beam has at least two kinds of colors, achieving a gorgeous lighting effect and a vibrant atmosphere.

10 Claims, 2 Drawing Sheets

(56) References Cited

U.S. PATENT DOCUMENTS

| | | | | |
|---|---|---|---|---|
| 2008/0291561 | A1* | 11/2008 | Bornhorst | G02B 26/00 359/890 |
| 2012/0281415 | A1 | 11/2012 | Bornhorst | |

FOREIGN PATENT DOCUMENTS

| | | | | | |
|---|---|---|---|---|---|
| CN | 103486548 | A | | 1/2014 | |
| CN | 203718614 | U | * | 7/2014 | |
| CN | 203718614 | U | | 7/2014 | |
| CN | 105135367 | A | | 12/2015 | |
| CN | 206369178 | U | | 8/2017 | |
| CN | 207729515 | U | | 8/2018 | |
| CN | 209399229 | U | | 9/2019 | |
| WO | WO-03056841 | A1 | * | 7/2003 | F21V 9/40 |

* cited by examiner

MULTICOLOR LIGHTING ADJUSTING DEVICE

CROSS-REFERENCE TO RELATED APPLICATIONS

The present application is a national phase entry under 35 U.S.C § 371 of International Application No. PCT/CN2019/123347 filed Dec. 5, 2019, which claims priority from Chinese Patent Application No. 201920413685.0 filed Mar. 29, 2019, all of which are hereby incorporated herein by reference.

TECHNICAL FIELD

The invention relates to the technical field of stage lights, and in particular to a multicolor lighting adjusting device.

BACKGROUND ART

Stage lights can be used to create different atmospheres by adding different color filters to achieve color conversion of various colors. However, the color filter generally includes only a single color, and the color of the pattern often tends to be in one pure color, so that it is slightly monotonous, and is unsuitable for dance halls, parties and other active places that typically require some dreamy lighting effects.

SUMMARY

In order to overcome at least one of the deficiencies in the prior art described above, the present invention provides a multicolor lighting adjusting device which is able to project a light beam with at least two kinds of colors, thus achieving a gorgeous lighting effect and a vibrant atmosphere.

According to the present invention, the multicolor lighting adjusting device comprises a substrate, a color mixing plate that is transparent and mounted on the substrate, and a drive mechanism for driving the color mixing plate. The substrate has a light transmission hole. The color mixing plate has a plurality of color zones thereon. The color zones are randomly distributed in shape and/or color, and the colors of two adjacent color zones are mutually different. The color mixing plate has a first remaining position at which point a light beam passing through the light transmission hole is intercepted by at least two color zones on the color mixing plate.

In the present invention, by the configuration of the transparent color mixing plate and a plurality of color zones randomly distributed in shape and/or color on the color mixing plate, the light beam passing through the light transmission hole is intercepted by at least two color zones on the color mixing plate, so that the projected light beam has at least two kinds of colors, thus achieving a gorgeous lighting effect and a vibrant atmosphere.

Further, the color zones are formed by mixing a plurality of self-forming color zones with irregular extension and distribution. In this way, projected color regions are rounded and smooth, and appear to be more natural.

Further, no gap exists between two adjacent color zones. A blank or a shadow is avoided from forming between the two color regions to cause visual discomfort.

Further, the color of at least portion of the color zones are formed by mixing the colors of two adjacent color zones. Therefore, the color contrast of the projected color regions will not be too strong and has a certain transition.

Further, the drive mechanism includes a rotation mechanism for driving the color mixing plate to rotate, and a center of the color mixing plate is connected with the rotation mechanism. The color mixing plate is driven by the rotation mechanism to rotate, so that the color zones for intercepting the light beam change constantly, the projected color regions thus have a dynamic effect, and the colors are more gorgeous.

Further, the center of the color mixing plate is pivotally connected to a mounting plate through a driven wheel driven by a driving wheel through synchronous belts.

Further, during the rotation of the color mixing plate, the light beam passing through the light transmission hole is always intercepted by at least two of the color zones on the color mixing plate. Thus, the color richness of the projected color regions is guaranteed.

Further, the drive mechanism includes a moving mechanism that drives the color mixing plate to move. The moving mechanism can drive the color mixing plate to move in and out of a light path of the light beam, and when a gorgeous color is not needed, the color mixing plate can be moved out of the light path of the light beam.

Further, the color mixing plate is mounted on the mounting plate that is connected to a rotating shaft of a motor. The color mixing plate moves in and out of the light path through the swing of the mounting plate.

Further, the color mixing plate has a second remaining position at which point the color mixing plate is out of the light path of the light beam passing through the light transmission hole.

Further, a pattern plate is further included on which at least one pattern sheet is provided, and the light beam passing through the light transmission hole may be intercepted by the pattern sheet. The pattern sheet enables the projected light beam to have various patterns matched with the colors of the color mixing plate, so that the effect of the stage light becomes richer.

REFERENCE NUMERALS

Figure 1:
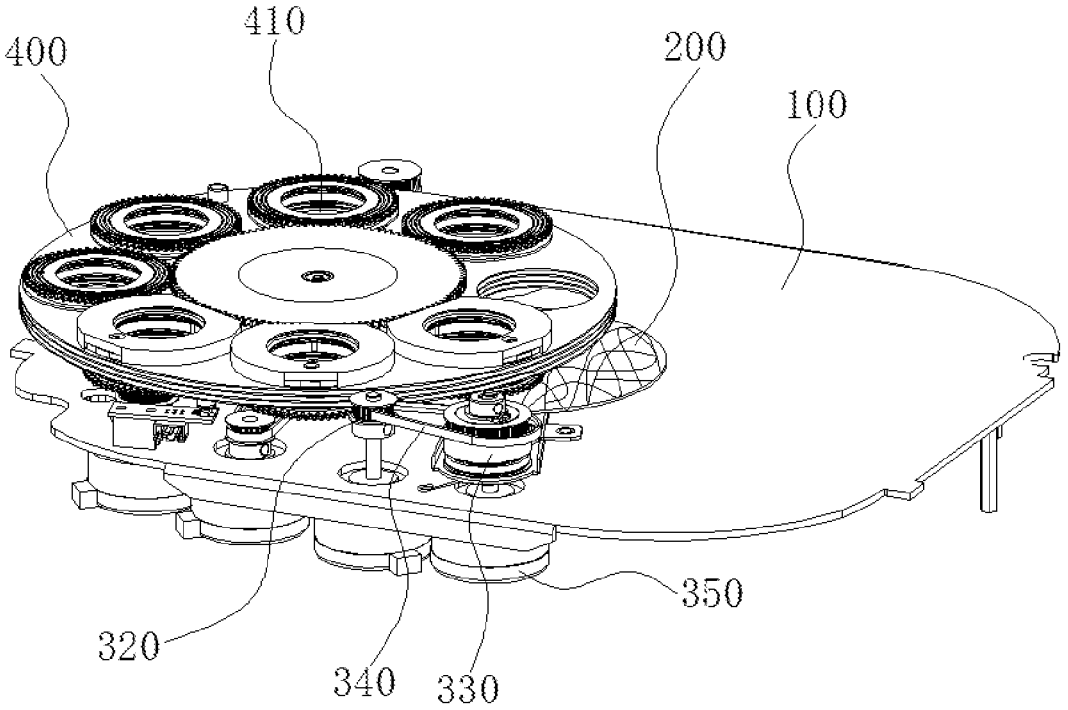
FIG. 1 is a schematic structural view of a color mixing plate at a first remaining position according to one embodiment.

100 substrate; 110 light transmission hole; 200 color mixing plate; 210 color zones; 300 mounting plate; 310 driven wheel; 320 driving wheel; 330 drive wheel; 340 synchronous belts; 350 motor; 400 pattern plate; 410 pattern sheet(s).

EMBODIMENTS

The drawings are for illustration purpose only and are not intended to limit the present invention. Some components in the drawings may be omitted, enlarged, or reduced for better illustrating the embodiments, and sizes of these components do not represent sizes of actual products. For those skilled in the art, it will be understood that some known structures in the drawings and descriptions thereof may be omitted. The positional relationships described in the drawings are for illustration purpose only and are not intended to limit the present invention.

Figure 2:
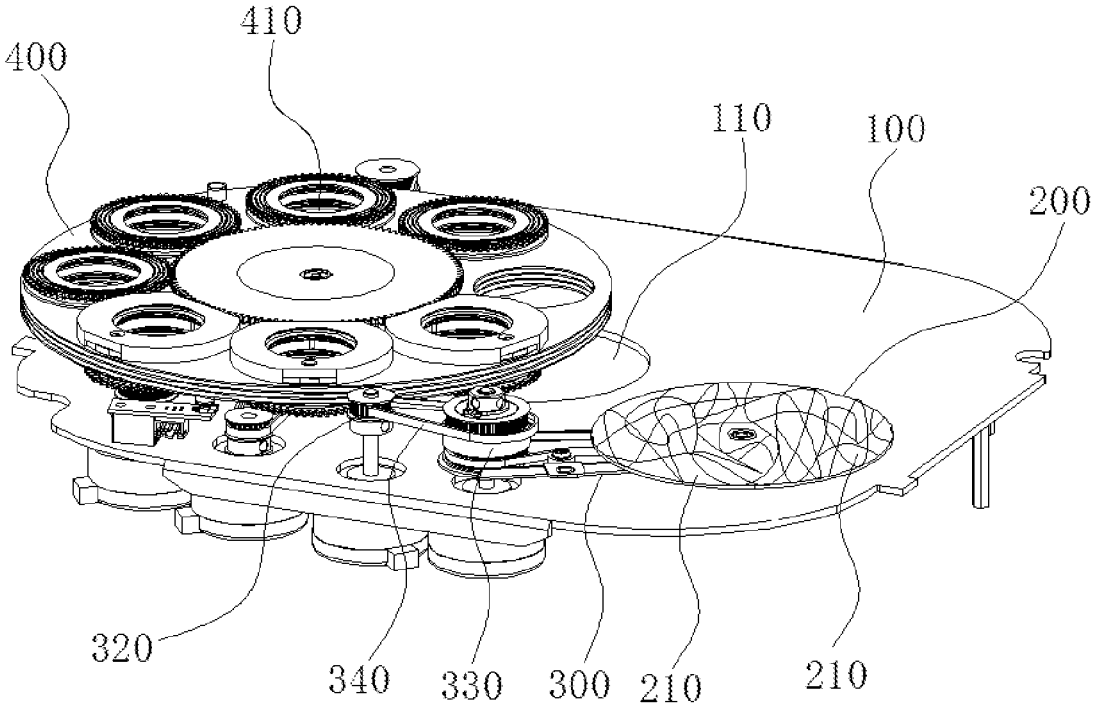
FIG. 2 is a schematic structural view of the color mixing plate at a second remaining position according to one embodiment.
Figure 3:
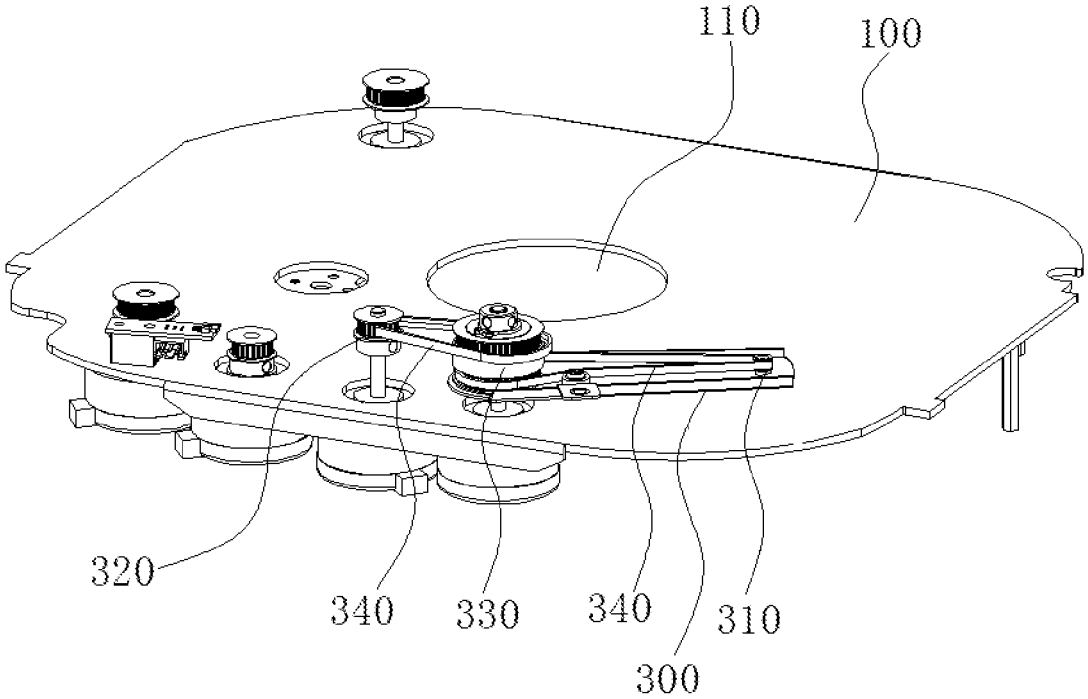
FIG. 3 is a schematic structural view of a drive mechanism according to one embodiment.

As shown in FIGS. 1 to 3, according to one embodiment, the multicolor lighting adjusting device comprises a substrate 100, a color mixing plate 200 that is transparent and mounted on the substrate 100, and a drive mechanism for driving the color mixing plate 200. The substrate 100 has a light transmission hole 110. The color mixing plate 200 has a plurality of color zones 210 thereon, the color zones 210 are randomly distributed in shape and/or color, and the colors of two adjacent color zones 210 are mutually different. The color mixing plate 200 has a first remaining position at which point a light beam passing through the light transmission hole 110 is intercepted by at least two of the color zones 210 on the color mixing plate 200.

According to the present embodiment, by the configuration of the transparent color mixing plate 200 and a plurality of color zones 210 randomly distributed in shape and/or color on the color mixing plate 200, the light beam passing through the light transmission hole 110 is intercepted by at least two color zones 210 on the color mixing plate 200, so that the projected light beam has at least two kinds of colors, thus achieving a gorgeous lighting effect and a vibrant atmosphere. It should be noted that although the color mixing plate 200 is transparent, it can be provided with color zones 210 having colors, and an extent of transparency can be selected by itself as long as the light beam is not completely blocked and can transmit the color zones, that is, the color mixing plate 200 is made of a colored transparent material.

In one preferred embodiment, the color zones 210 are formed by coating a film on the transparent color mixing plate 200.

In another preferred embodiment, two adjacent color zones 210 have two different colors rather than two different color shades of the same color. Therefore, the projected light beams are in relatively sharp contrast at the two generated color regions, which can achieve better atmosphere.

In another preferred embodiment, the color zones 210 are formed by mixing a plurality of self-forming color zones with irregular extension and distribution. In this way, projected color regions are rounded and smooth, and appear to be more natural. Alternatively, multiple colors can be separated from each other and cannot be mixed together.

In another preferred embodiment, there is no gap between two adjacent color zones 210. That is, there is no colorless transparent region between two adjacent color zones 210 which may also not be separated by an opaque object. The color mixing plate 200 is entirely a transparent plate, and is mounted directly on the drive mechanism without being mounted to other various frames, so as to avoid forming a blank or a shadow between two color regions to cause visual discomfort.

In another preferred embodiment, the color of at least portion of the color zones 210 are formed by mixing the colors of two adjacent color zones 210. Therefore, the color contrast of the projected color regions will not be too strong and has a certain transition.

In another preferred embodiment, the color mixing plate 200 is in a circular shape, the color zones 210 are provided around a center of the color mixing plate 200, and when the color mixing plate 200 is at the first position, the light beam passes through the region where the color mixing plate 200 is provided with the color zones 210.

In another preferred embodiment, the drive mechanism includes a rotation mechanism for driving the color mixing plate 200 to rotate relative to its own axis, and the center of the color mixing plate 200 is connected to the rotation mechanism. The color mixing plate 200 is driven by the rotation mechanism to rotate relative to its own axis, so that the color zones 210 for intercepting the light beam change constantly, the projected color regions thus have a dynamic effect, and the colors are more gorgeous.

In another preferred embodiment, the center of the color mixing plate 200 is pivotally connected to a mounting plate 300 through a driven wheel 310 driven by a driving wheel 320 through synchronous belts 340. In other embodiments, the driving wheel 320 may also drive the driven wheel 310 to rotate in an engaged manner.

In another preferred embodiment, during the rotation of the color mixing plate 200, the light beam passing through the light transmission hole 110 is always intercepted by at least two of the color zones 210 on the color mixing plate 200. Thus, the color richness of the projected color regions is guaranteed.

In another preferred embodiment, width of each color zone 210 in a radial direction of the color mixing plate 200 are smaller than a diameter of the light transmission hole 110. Therefore, it can be guaranteed that during the rotation of the color mixing plate 200, the light beam passing through the light transmission hole 110 is always intercepted by at least two of the color zones 210 on the color mixing plate 200.

In another preferred embodiment, the drive mechanism includes a moving mechanism that drives the color mixing plate 200 to move. The moving mechanism can drive the color mixing plate 200 to move in and out of a light path of the light beam. When a gorgeous color is not needed, the color mixing plate 200 can be moved out of the light path of the light beam.

In another preferred embodiment, the color mixing plate 200 is mounted on the mounting plate 300 that is connected to a rotating shaft of a motor 350. The color mixing plate 200 moves in and out of the light path through the swing of the mounting plate 300. In this way, the spatial volume occupied by the moving mechanism is reduced to facilitate the mounting of other elements.

In another preferred embodiment, the drive wheel 330 is pivotally connected to the rotating shaft of the motor 350, and the driving wheel 320 and the driven wheel 310 are connected to the drive wheel 330 through a synchronous belt 340 respectively.

In another preferred embodiment, the color mixing plate 200 has a second remaining position at which point the color mixing plate 200 is out of the light path of the light beam passing through the light transmission hole 110.

In another preferred embodiment, a pattern plate 400 is further included on which at least one pattern sheet 410 is provided, and the light beam passing through the light transmission hole 110 can be intercepted by the pattern sheet 410. The pattern sheet 410 enable the projected light beam to have various patterns matched with the colors of the color mixing plate 200, so that the effect of the stage light becomes richer.

Obviously, the above embodiments of the present invention are merely examples for clear illustration of the invention, and are not intended to limit the implementation of the invention. For those skilled in the art, modifications or changes in other forms can also be made on the basis of the above description. It is unnecessary and impossible to exhaust all implementations herein. Any modification, equivalent substitution or improvement and the like within the spirit and principle of the present invention should be included in the scope of claims of the present invention.

The invention claimed is:

1. A multicolor lighting adjusting device, comprising:

a substrate;

a color mixing plate which is transparent and mounted on the substrate; and a drive mechanism for driving the color mixing plate, wherein the substrate has a light transmission hole, the color mixing plate has a plurality of color zones thereon, the color zones are randomly distributed in shape and/or color and the colors of two adjacent color zones are mutually different, and the color mixing plate has a first remaining position at which point the color mixing plate is in a light path of a light beam passing through the light transmission hole, and the light beam passing through the light transmission hole is intercepted by at least two of the color zones on the color mixing plate, and wherein a color of at least portion of the color zones is formed by mixing the colors of two adjacent color zones thereof.

2. The multicolor lighting adjusting device according to claim 1, wherein the color zones are formed by mixing a plurality of self-forming color zones with irregular extension and distribution.

3. The multicolor lighting adjusting device according to claim 1, wherein no gap exists between two adjacent color zones.

4. The multicolor lighting adjusting device according to claim 1, wherein the drive mechanism includes a rotation mechanism for driving the color mixing plate to rotate relative to its own axis, and a center of the color mixing plate is connected to the rotation mechanism.

5. The multicolor lighting adjusting device according to claim 4, wherein the center of the color mixing plate is pivotally connected to a mounting plate through a driven wheel driven by a driving wheel through synchronous belts.

6. The multicolor lighting adjusting device according to claim 4, wherein the light beam passing through the light transmission hole is always intercepted by at least two of the color zones on the color mixing plate during rotation of the color mixing plate.

7. The multicolor lighting adjusting device according to claim 1, wherein the drive mechanism includes a moving mechanism that drives the color mixing plate to move.

8. The multicolor lighting adjusting device according to claim 7, wherein the color mixing plate is mounted on a mounting plate that is connected to a rotating shaft of a motor.

9. The multicolor lighting adjusting device according to claim 7, wherein the color mixing plate further has a second remaining position at which point the color mixing plate is out of the light path of the light beam passing through the light transmission hole.

10. The multicolor lighting adjusting device according to claim 1, further comprising a pattern plate, wherein the pattern plate provides at least one pattern sheet, and the light beam passing through the light transmission hole is capable of being intercepted by the pattern sheet.

* * * * *